United States Patent [19]

Hanzawa et al.

[11] Patent Number: 4,800,985

[45] Date of Patent: Jan. 31, 1989

[54] SILENCER WITH A SIDE BRANCH

[75] Inventors: Yukihiko Hanzawa; Haruki Kawauchi, both of Tochigi; Tukasa Mikami, Saitama; Akinobu Takagi, Kanagawa; Yohji Kurotobi, Saitama, all of Japan

[73] Assignee: Honda Giken Kogyo Kabushiki Kaisha, Tokyo, Japan

[21] Appl. No.: 830,561

[22] Filed: Feb. 18, 1986

[30] Foreign Application Priority Data

| | | | |
|---|---|---|---|
| Feb. 18, 1985 | [JP] | Japan | 60-30026 |
| Apr. 29, 1985 | [JP] | Japan | 60-63799[U] |
| May 22, 1985 | [JP] | Japan | 60-109848 |

[51] Int. Cl.[4] ..... F01N 1/02

[52] U.S. Cl. ..... 181/229; 181/250

[58] Field of Search ..... 181/227-229, 181/240, 241, 243, 250, 251, 275, 276, 212; 138/120, 122, 123, 125, 144, 155

[56] References Cited

U.S. PATENT DOCUMENTS

| | | | |
|---|---|---|---|
| 221,127 | 10/1879 | Walker | 138/155 X |
| 2,096,260 | 10/1937 | Pavillon | 181/265 |
| 2,297,046 | 9/1942 | Bourne | 181/250 |
| 3,396,812 | 8/1968 | Wilcox et al. | 181/250 |
| 3,525,419 | 8/1970 | Cassel | 181/212 |
| 4,098,298 | 7/1978 | Vohrer | 138/122 |
| 4,350,223 | 9/1982 | Takei | 181/229 |
| 4,389,982 | 6/1983 | Boyeser | 123/73 R |
| 4,578,855 | 4/1986 | Van Der Hagan | 138/122 |

FOREIGN PATENT DOCUMENTS

| | | | |
|---|---|---|---|
| 216292 | 7/1961 | Austria | 181/229 |
| 0091038 | 10/1983 | European Pat. Off. . | |
| 968347 | 9/1964 | United Kingdom . | |

OTHER PUBLICATIONS

MTZ Motortechniche, vol. 22, p. 329, Aug. 1961.

*Primary Examiner*—Benjamin R. Fuller
*Attorney, Agent, or Firm*—Lyon & Lyon

[57] ABSTRACT

A silencer includes an air passage tube having an air inlet for introducing air thereinto, and a side branch tube connected to the air passage tube and having a closed end for attenuating noise produced by the air introduced into the air passage tube. The side branch tube may be either a flexible tube or have a flexible portion for allowing convenient bending and mounting thereof in the available space. The side branch tube may comprise a pair of different tube portions connected to each other. The side branch tube may have a water drain hole defined in its lowermost portion and preferably the cross-sectional area of the water drain hole is no greater than 1% of the cross-sectional area of the side branch tube. The side branch tube serves to attenuate high-frequency noise and the silencer may additionally include a resonator chamber for attenuating low-frequency noise.

24 Claims, 8 Drawing Sheets

SILENCER WITH A SIDE BRANCH

The present invention relates to a silencer for the air intake system of an automobile engine and, more particularly, to a silencer of the type having a side branch tube connected to the air intake passage tube with the side branch tube having a closed end.

Silencers having a closed-end side branch tube connected to an air intake passage tube are well known in the art as disclosed in Japanese Laid-Open Utility Model Publication Nos. 48 (1973)-32734, 50(1975)-11104, 50(1975)-136804, 51(1976)-16144, and 56(1981)-138108, and Japanese Laid-Open Patent Publication No. 55(1980)-51910.

Where the side branch tube is directed downwardly, the moisture contained in air introduced therein is condensed and trapped therein. The trapped water may be removed through a drain hole defined in the lowermost end of the side branch tube. However, the drain hole tends to reduce the ability of the side branch tube to attenuate the sound produced in the air passage tube.

The length and cross-sectional area of the side branch tube is determined by the resonant frequency thereof. The side branch tube is straight in each of the silencers disclosed in the aforesaid publications and is either perpendicular to the air passage tube or connected by an elbow to extend parallel to the air passage tube. Where the silencer is to be combined with the intake system of an internal combustion engine in an automobile, however, there is insufficient installation space for the straight side branch tube available since various components are disposed around the intake tube.

For some noise frequencies to be attenuated, the side branch tube must be of an increased length which cannot be installed with ease. Furthermore, for some purposes it is desirable for the side branch tube to be of different materials at its opposite ends.

SUMMARY OF THE INVENTION

It is an object of the present invention to provide an intake air silencer including a side branch tube which is flexible at least partially for installation in a limited space.

Another object of the present invention is to provide a silencer including a side branch tube composed of different tube members for easy installation.

Still another object of the present invention is to provide a silencer including a side branch tube having a water drain hole defined in a closed end thereof, the water drain hole having a cross-sectional area selected with respect to the cross-sectional area of the side branch tube for minimizing any reduction in the sound-suppressing ability of the side branch tube.

A still further object of the present invention is to provide a silencer including a side branch tube having a closed end for attenuating high-frequency noise and a resonator chamber for attenuating low-frequency noise.

According to the present invention, the silencer includes an air passage tube having an air inlet for introducing air thereinto, and a side branch tube connected to the air passage tube and having a closed end for attenuating noise produced by the air introduced into the air passage tube, the side branch tube being at least partially flexible. The side branch tube may comprise an entirely flexible tube or a pair of different tube portions connected to each other and bent two-dimensionally. The side branch tube may include a flexible bellows tube portion. Further, the side branch tube may have a water drain hole defined in its lowermost portion, which may be the closed end, with the hole having a cross-sectional area which is no greater than 1% of the cross-sectional area of the side branch tube. The side branch tube may serve to attenuate high-frequency noise, and the silencer may additionally include a resonator chamber for attenuating low-frequency noise.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 6(*b*) is a schematic diagram showing the dimensions of a side branch tube of the silencer of FIG. 4.

DESCRIPTION OF THE PREFERRED EMBODIMENTS

Figure 1:
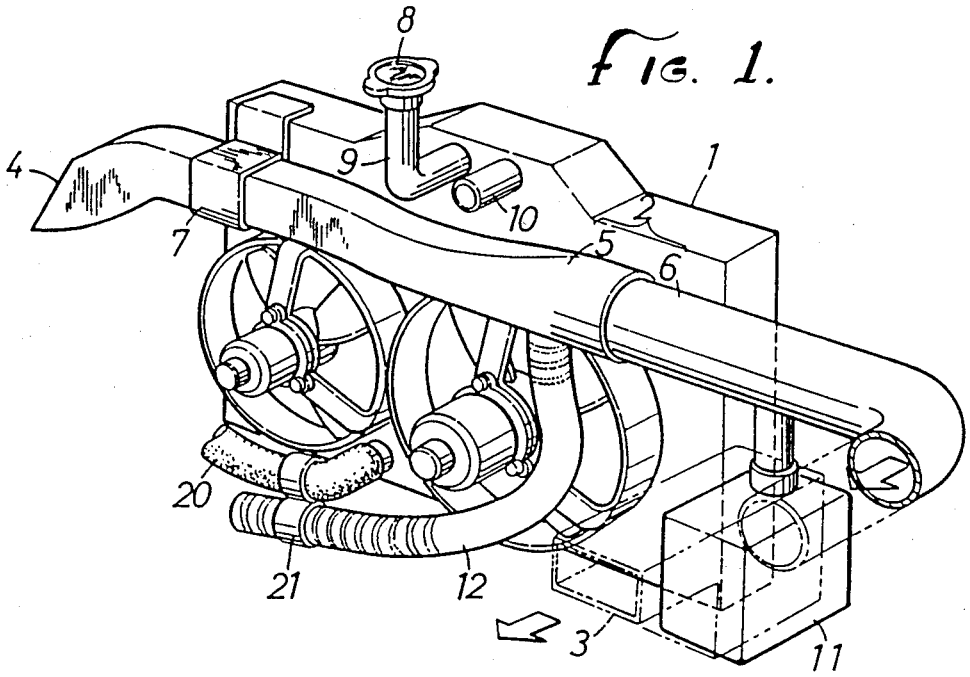
FIG. 1 is a perspective view of a silencer according to an embodiment of the present invention for being incorporated in the air intake system of an automotive internal combustion engine (not shown).

FIG. 1 shows a silencer according to an embodiment of the present invention, which is incorporated in an automotive internal combustion engine (not shown). The silencer includes an air passage tube 2 serving as an air intake tube and that for convenience is positioned between a radiator 1 and the internal combustion engine. The air intake tube 2 is connected to an air cleaner 3.

The air intake tube 2 comprises a first tube member 5 having an air inlet 4 at one end thereof for introducing air thereinto, and a second tube member 6 having one end connected to the other end of the first tube member 5 and the opposite end to the air cleaner 3. The first tube member 5 is fixedly supported on the radiator 1. The first tube member 5 has a bent shape to avoid interference with a coolant supply tube 9 connected to an upper portion of the radiator 1 and closed off by a cap 8, and a connector tube 10 coupled to the upper portion of the radiator 1 for connection to an upper hose (not shown) coupled to the engine.

The silencer also includes a resonator chamber 11 and a side branch tube 12 which are connected to the air intake tube 2 for attenuating sounds arising from the radiation of a standing wave from the air inlet 4 due to the resonance of waves of compression and expansion generated by the combustion chambers of the engine. The resonator chamber 11 is connected to the air intake tube 2 close to the air cleaner 3, i.e., to a lower side wall of the second tube member 6. The side branch tube 12 is connected to a lower side wall of the first tube member 5 close to the second tube member 6.

Figure 2:
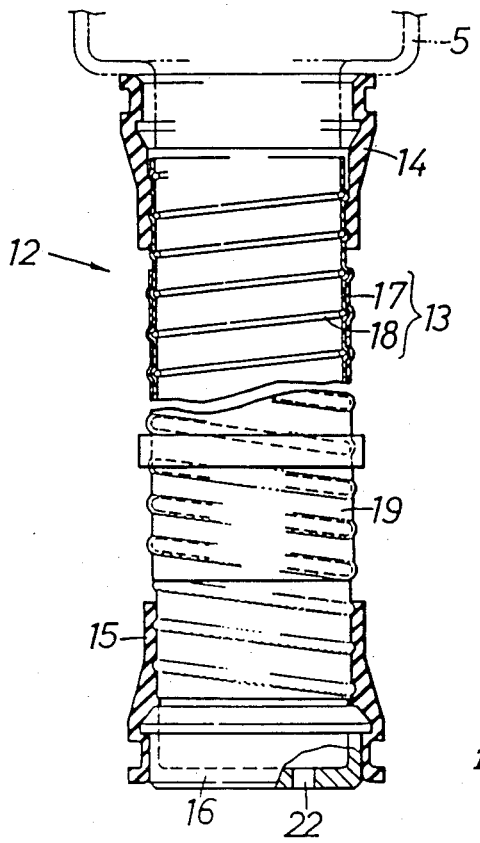
FIG. 2 is an enlarged fragmentary cross-sectional view of a side branch tube of the silencer shown in FIG. 1.

As shown in FIG. 2, the side branch tube 12 comprises a flexible tube 13, a rubber joint 14 bonded to one end of the flexible tube 13, and another rubber joint 15 bonded to the other end of the flexible tube 13. A cap 16 is fitted in the rubber joint 15. The flexible tube 13 comprises a tube 17 of woven cloth reinforced with a helical wire 18 held against the inner surface thereof, and a protective layer 19 of synthetic resin covering the outer surface of the tube 17 for enhancing the sound attenuating characteristics of the side branch tube 12.

The side branch tube 12 has a length selected dependent on noise frequencies to be attenuated. The rubber joint 14 is joined to the lower side wall of the first tube member 5. As shown in FIG. 1, an end portion of the side branch tube 12 close to the rubber joint 15 extends near and is fastened by a clamp 21 to a lower hose 20 connected to a lower portion of the radiator 1 and also to the engine.

The cap 16 fitted in the rubber cap 15 on the lowermost end of the side branch tube 12 has a water drain hole 22 having a cross-sectional area which is equal to or less than 1% of the cross-sectional area of the side branch tube 12.

Figure 3:
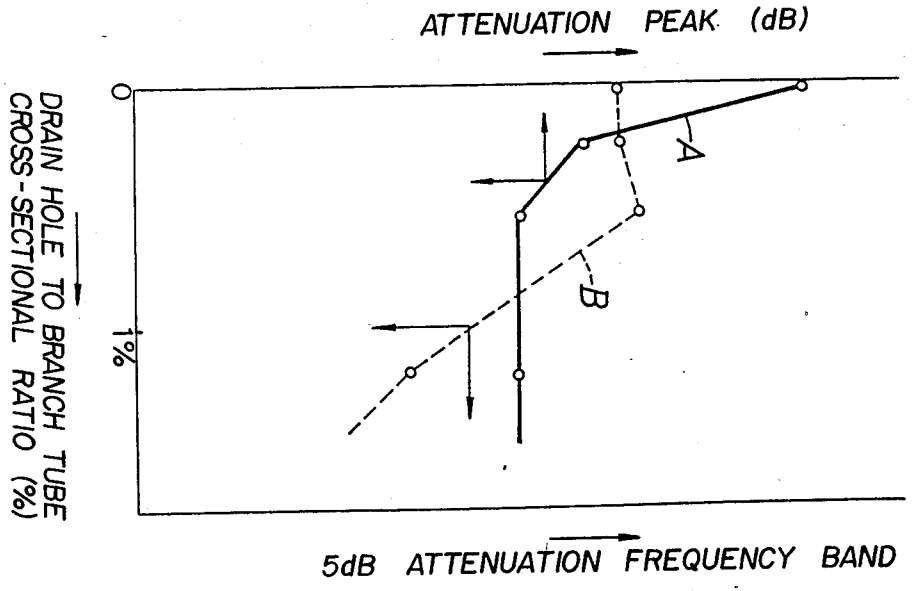
FIG. 3 is a graph showing the manner in which noise attenuation varies with the cross-sectional ratio between a drain hole and the side branch tube.

FIG. 3 shows a comparison of relative cross-sectional areas of the drain hole 22 and branch tube 12 developed by actual testing. In the tests, the side branch tube 12 had an inside diameter of 40 mm, and the diameter of the water drain hole 22 was varied, as shown by the four points, to plot attenuation peaks (indicated by the curve A in FIG. 3) and frequency bands in which an attenuation of 5 dB is achieved (indicated by the curve B in FIG. 3). As the diameter of the water drain hole 22 is increased, the attenuation peak is lowered in a range of about 5 dB, and the 5-dB attenuation band is lowered in a range of about 20 Hz.

It is clear from FIG. 3 that in order to keep the reduction of the attenuation peak in an allowable range such as 5 dB and minimize the lowering of the 5-dB attenuation band, it is necessary that the ratio of the crosssectional area of the water drain hole 22 to that of the side branch tube 12 be selected to be 1% of less. If the cross-sectional ratio is greater than the 1% range shown in FIG. 3, the sounds will be radiated through the water drain hole 22.

In order for the water drain hole 22 to drain water properly therethrough, its diameter should be at least 3 mm. Therefore, it is preferable that the water drain hole 22 have a diameter of at least 3 mm and a cross-sectional area which is approximately 1% or less of the cross-sectional area of the side branch tube 12.

The data shown in FIG. 3 was obtained with the water drain hole 22 concentric to the side branch tube 12. However, the same results will be obtained if the water drain hole 22 is eccentric with respect to the side branch tube 12. The side branch tube 12 may have its intermediate portion located as the lowermost portion rather than the end, and the drain hole may be defined in such lowermost intermediate portion.

The noise produced by the standing wave in the air intake tube 2 can be attenuated by the resonator chamber 11 and the side branch tube 12. Since the side branch tube 12 is flexible throughout its entire length, it can be bent and installed freely out of interference with other components in the limited space between the radiator 1 and the internal combustion engine.

In the foregoing embodiment, the silencer has been illustrated as including the resonator chamber 11. However, the silencer is effective for use as a resonant silencer for noise attenuation regardless of whether the resonator chamber 11 is added or not. Further, the side branch tube 12 may be of a different shape such as a straight tube.

Figure 4:
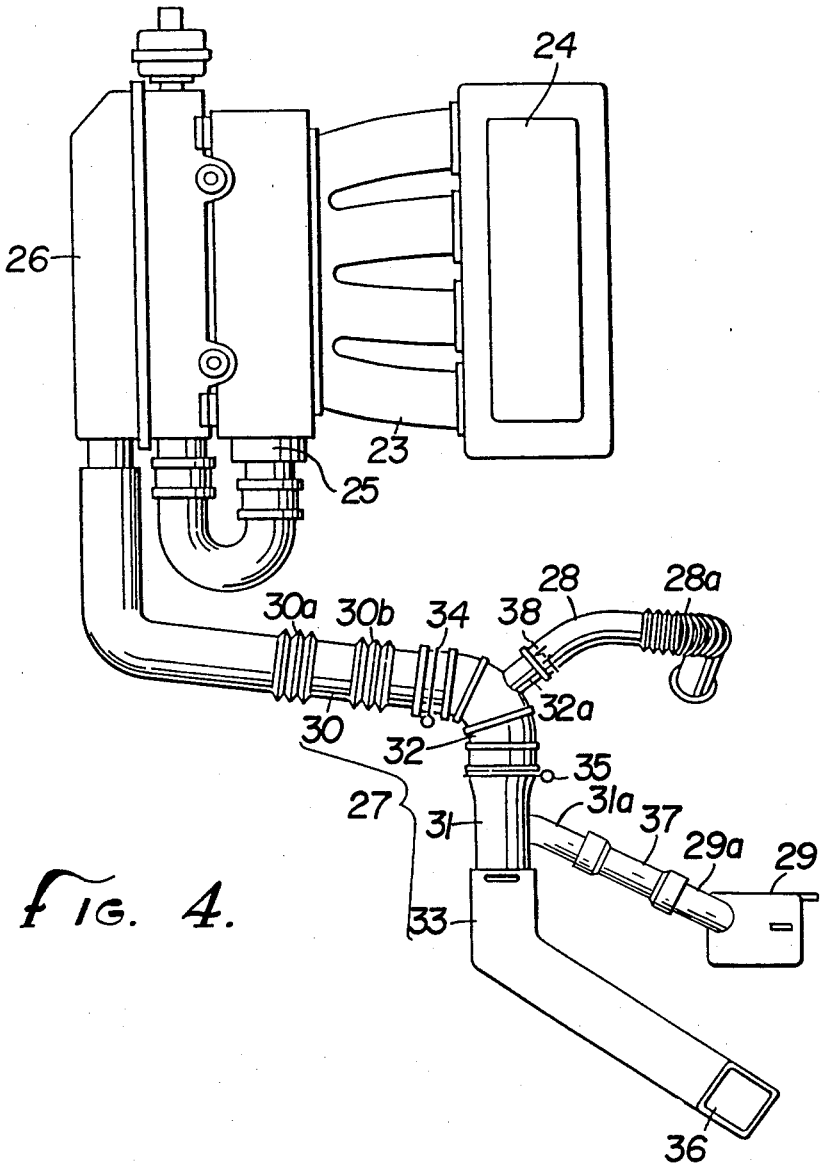
FIG. 4 is a plan view of a silencer according to another embodiment of the present invention, the silencer being incorporated in the air intake system of an automotive internal combustion engine.

FIG. 4 shows a silencer according to another embodiment of the present invention. An air intake system for an automotive internal combustion engine comprises an intake manifold 23 connected to the engine, denoted at 24, a throttle body 25 connected to the intake manifold 23, an air cleaner 26 connected to the throttle body 25, and an air intake tube 27 connected to the air cleaner 26 and serving as an air passage tube of the silencer. The silencer includes a side branch tube 28 and a resonator chamber 29 which are connected to the air intake tube 27 upstream of the air cleaner 26 for suppressing noise produced in the air intake system.

Figure 5:
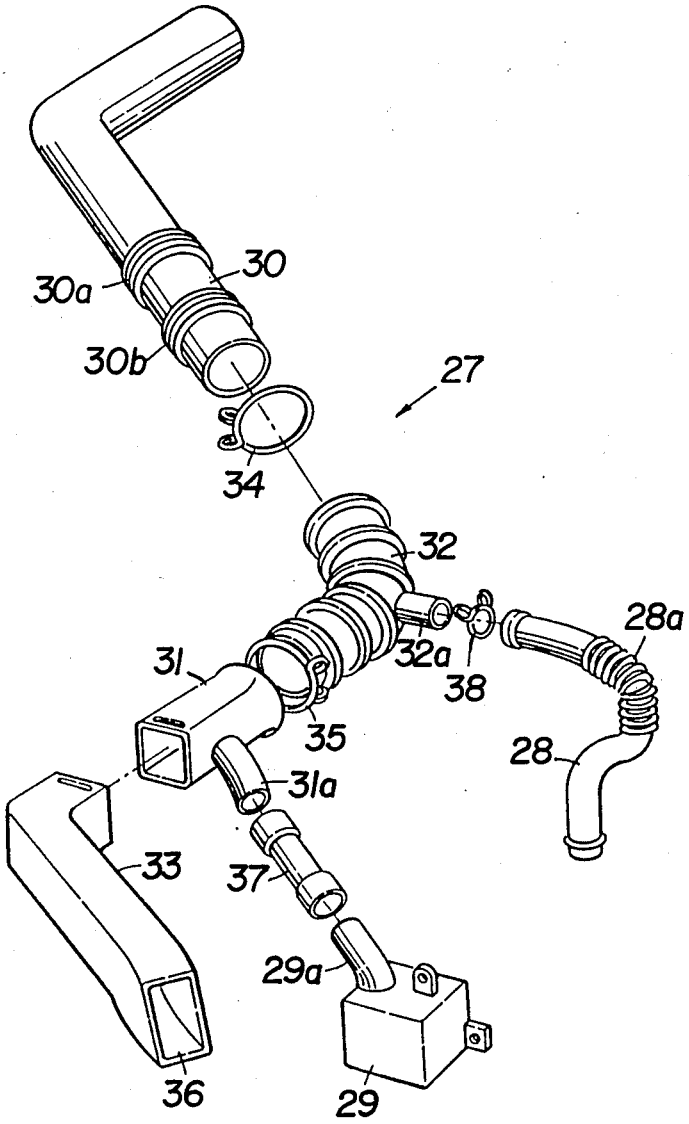
FIG. 5 is an exploded perspective view of the silencer shown in FIG. 4.

As shown in FIGS. 4 and 5, the air intake tube 27 comprises a substantially L-shaped cylindrical tube member 30, a first straight rectangular tube member 31 having a rectangular cross section, a connector tube member 32 interconnecting the cylindrical tube member 30 and the first rectangular tube member 31, and a second substantially L-shaped rectangular tube member 33 having a rectangular cross section and connected to the first rectangular tube member 31. The cylindrical tube member 30 has two spaced flexible bellows tube portions **30*a*, 30*b* and has one end connected to the air cleaner 26. The connector tube member 32 is made of a flexible material such as rubber and has one end fitted over the other end of the cylindrical tube member 30 and secured thereto by a clamp 34. The opposite end of the connector tube member 32 is fitted over one end of the first rectangular tube member 31 and secured thereto by a clamp 35. The connector tube member 32 is elbow-shaped to interconnect the cylindrical tube member 30 and the first rectangular tube member 31 substantially at a right angle. The second rectangular tube member 33 has one end fitted over the other end of the first rectangular tube member 31 and the opposite end opening as an air inlet 36**.

The resonator chamber 29 serves to attenuate noise in a low-frequency range and is connected to a lower side wall of the first rectangular tube member 31. The first rectangular tube member 31 has a short cylindrical joint tube member **31*a* extending obliquely downwardly and connected through a rubber connector or joint tube member 37 to a neck 29*a* of the resonator chamber 29**.

Figure 6A:
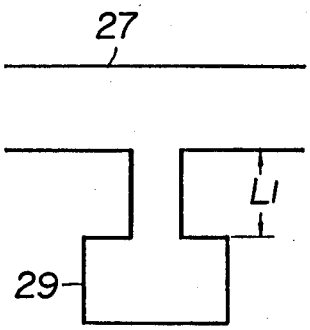
FIG. 6(*a*) is a schematic diagram showing the dimensions of a resonator chamber of the silencer of FIG. 4.
Figure 6B:
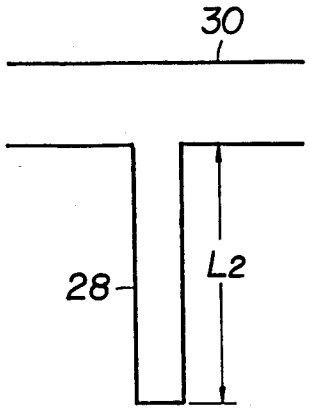

To attenuate low-frequency noise, the combined length (L1in FIG. 6(*a*)) of the joint tube member **31*a*, the rubber joint tube member 37, and the neck 29*a* from the first rectangular tube member 31 to the resonator chamber 29 should be relatively long. For reducing noise having a frequency of about 75 Hz, for example, the length L1 is 220 mm if the resonator chamber 29 has a volume of 3.6 liters and the neck 29***a* has an inside diameter of 52 mm.

If the resonator chamber 29 was to be used for attenuation of high-frequency noise, the length L1 must be reduced and the resonator chamber 29 would be positioned close to the first rectangular tube member 31, thereby imposing a substantial limitation on the layout of the silencer.

The side branch tube 28 serves to reduce noise in a high-frequency range and is connected to the bent portion of the elbow-shaped connector tube member 32. The connector tube member 32 has a short cylindrical joint tube member 32*a*. The side branch tube 28 has one end fitted over and secured to the joint tube member 32*a* by a clamp 38.

The side branch tube 28 has its distal end closed and extends downwardly in a meandering fashion out of physical interference with other components. The side branch tube 28 includes a flexible bellows tube portion 28*a*.

The side branch tube 28 is of a relatively small length (L2 in FIG. 6(*b*)) for reducing high-frequency noise. For attenuating noise having a frequency of 116 Hz, for example, the length L2 is 745 mm if the inside diameter of the side branch tube 28 is 40 mm.

If the side branch tube 28 was to be used for suppressing noise in a low-frequency range, the length L2 must be increased, and hence the layout of the side branch tube 28 would become complex to avoid physical interference with other components.

Figure 7:
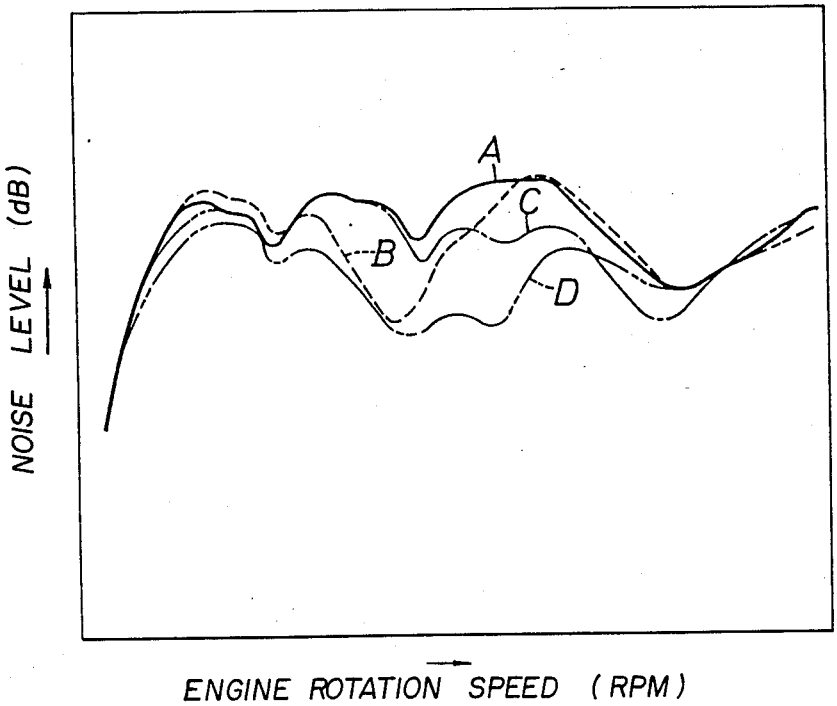
FIG. 7 is a graph illustrating the relationship between the air intake noise level and the engine rotation speed.

When the engine 24 operates, noise is produced in the air intake system. The produced noise can be lowered in a wide frequency range by the resonator chamber 29 and the side branch tube 28. FIG. 7 shows characteristic curves exhibiting such a noise reduction. More specifically, the noise level attained when the air intake system does not have the resonator chamber 29 and the side branch tube 28 is indicated by the solid-line curve A in FIG. 7. When the air intake system has only the resonator chamber 29, the noise level is lowered at lower engine rotation speeds, i.e., in a low-frequency range as indicated by the dotted-line curve B. When the air intake system has only the side branch tube 28, the noise level is lowered at higher engine rotation speeds, i.e., in a high-frequency range as indicated by the dot-and-dash-line curve C. The noise level produced by the air intake system of FIGS. 4 and 5 which has both the resonator chamber 29 and the side branch tube 28 is low in a wide frequency range from low to high frequencies as indicated by the two-dot-and-dash-line curve D.

Since the side branch tube 28 includes the bellows tube portion 28*a*, the side branch tube 28 can freely be bent at the bellows tube portion 28*a* out of physical contact with other components. The silencer can therefore be used in environments having various space limitations.

Figure 8:
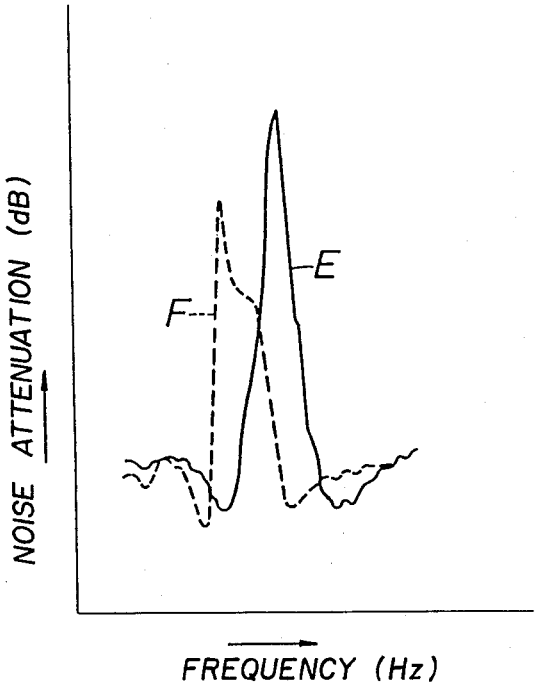
FIG. 8 is a graph showing noise attenuation characteristic curves obtained by side branch tubes with and without a bellows tube member.

The noise attenuation capability of the side branch tube 28 is not substantially lowered by the presence of the bellows tube portion 28*a*. More specifically, the noise attenuation curve E in FIG. 8 represents tests with a straight side branch tube and the noise attenuation curve F represents tests with the side branch tube bent and the bellows tube portion having a length which was about 30% of the entire length of the side branch tube. No significant difference is seen between the noise attenuation levels indicated by the curves E, F., although the frequency attenuated changes.

Figure 9:
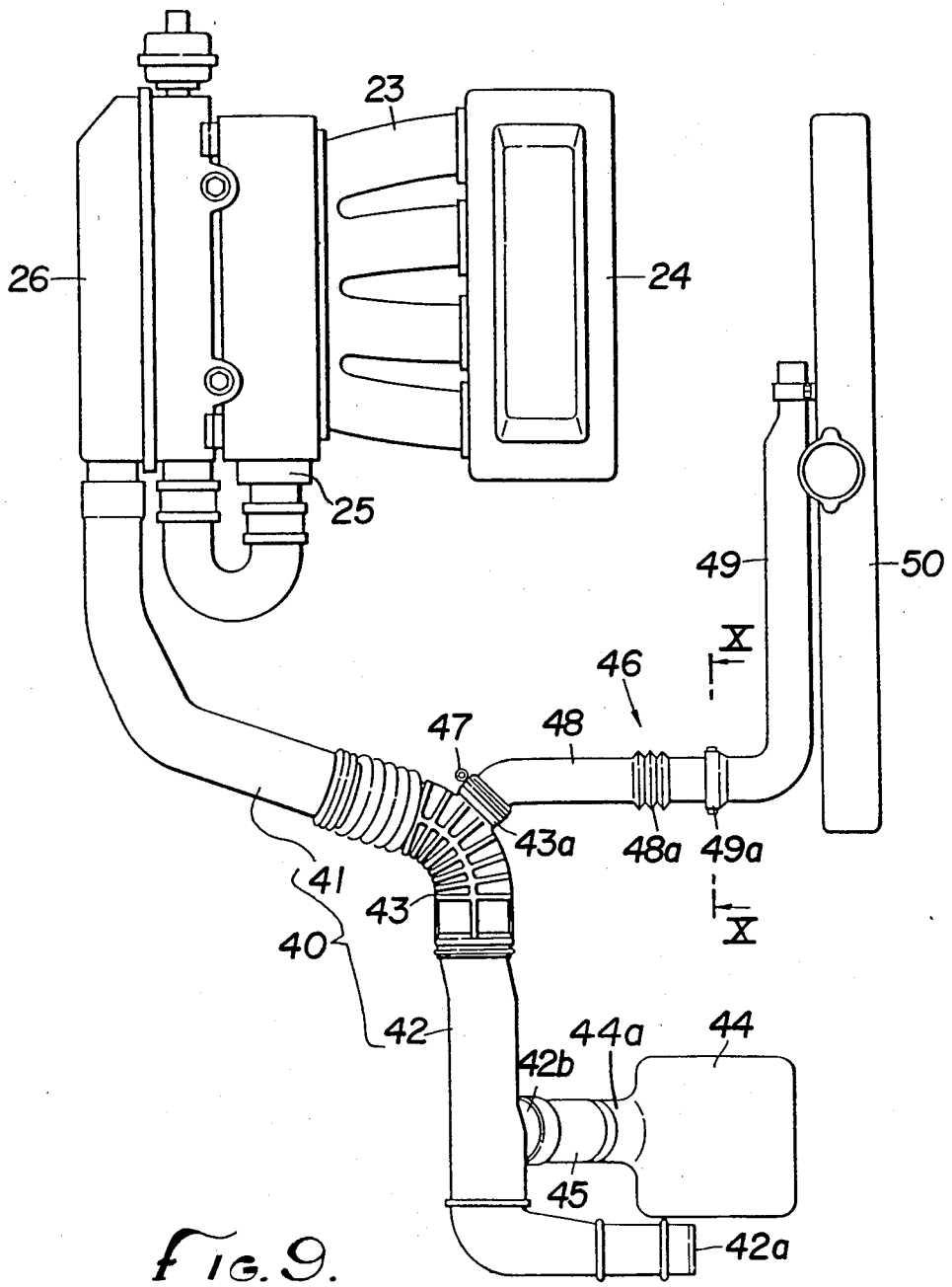
FIG. 9 is a plan view of a silencer according to still another embodiment of the present invention, the silencer being incorporated in the air intake system of an automotive internal combustion engine.

FIG. 9 shows a silencer according to still another embodiment of the present invention. The silencer includes an air intake tube or air passage tube 40 comprising a first tube member 41 connected to the air cleaner 26 and bent laterally of the throttle body 25, a second tube member 42 extending laterally of the engine 24 in the direction along the crankshaft (not shown) of the engine 24 and having an air inlet 42*a* defined in its distal end and directed forwardly of the automobile, and an elbow-shaped connector tube member 43 interconnecting the first and second tube members 41, 42.

The silencer has a resonator chamber 44 connected to a lower side wall of the second tube member 42. More specifically, the second tube member 42 has a short cylindrical joint tube member 42*b* extending obliquely downwardly and connected through a rubber joint tube member 45 to a neck 44*a* of the resonator chamber 44.

The silencer also includes a side branch tube 46 connected to the bent portion of the connector tube member 43. The connector tube member 43 is made as of rubber and includes a short joint tube member 43*a* fitted over and secured to one end of the side branch tube 46 by a clamp 47.

The side branch tube 46 comprises first and second tube members 48, 49 interconnected to each other. To avoid physical contact with other components, the first tube member 48 is bent laterally of the engine 1 in the forward direction, and the second tube member 49 is bent in the lateral direction along the crankshaft and also along the rear surface of a radiator 50.

The first tube member 48 has one end connected to the joint tube member 43*a* and is required to be shock-resistant to keep itself coupled to the joint tube member 43*a*. The first tube member 48 also has an intermediate flexible bellows tube portion 48*a*. The first tube member 48 is also required to be reduceable in thickness and more or less resilient for forming the bellows tube portion 48*a*. To meet the above requirements, the first tube member 48 is formed of a mixture of polypropylene and rubber, for example, by blow molding.

The second tube member 49 is supported by the radiator 50 and has one end connected to the first tube member 48 and the opposite end closed. Since the second tube member 49 is located in the vicinity of the exhaust manifold (not shown) of the engine 1, the second tube member 49 is required to be heat-resistant. To meet this requirement, the second tube member 49 is formed of polypropylene, for example, by blow molding.

Figure 10:
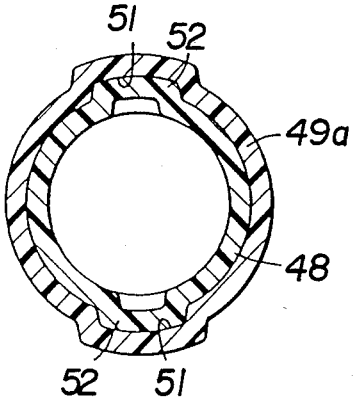
FIG. 10 is an enlarged cross-sectional view taken along line X—X of FIG. 9.

As illustrated in FIG. 10, the end of the second tube member 49 connected to the first tube member 48 has a larger-diameter portion 49*a* in which the end of the first tube member 48 is fitted. The larger-diameter portion 49*a* has a pair of diametrically opposite recesses 51, 51 extending radially outwardly. The fitted end of the first tube member 48 has a pair of diametrically opposite projections 52, 52 projecting radially outwardly and fitted complementarily in the recesses 51, 51, repsectively. Therefore, the first and second tube member 48, 49 are fitted together with directionality and relatively positioned when interconnected.

Noises produced in the air intake system when the engine 24 operated is attenuated by the resonator chamber 44 and the side branch tube 46. In assembly, the side branch tube 46 can easily be handled and assembled since it is composed of the two separate tube members 48, 49, which are relatively short. The two separate tube members 48, 49 can be of different materials to allow the side branch tube 46 to have different properties at its opposite ends. If the side branch tube 46 were formed as a unitary piece by blow molding, a relatively large mold would be required to mold the side branch tube 46. However, the two separate tube members 48, 49 can be molded by small molds, resulting in a cost reduction. Further, the side branch tube 46 is usually of a complex three-dimensional shape, but in this embodiment can be divided into the first and second tube members 48, 49 each of a two-dimensional shape. Therefore, the side branch tube 46 can be formed by two-dimensional blow molding by separately forming the first and second tube members 48, 49 in the blow molding process. This can achieve an additional cost reduction. If the side branch tube 46 were molded as a unitary construction, it would be difficult to uniformize the wall thickness and form the bellows tube portion 48*a*. However, inasmuch as the bellows tube portion 48*a* is provided on the first tube member 48 which is relatively short and more or less resilient, the bellows tube portion 48*a* can be formed which has a uniform wall thickness and an appropriate degree of resiliency.

Although certain preferred embodiments have been shown and described, it should be understood that many changes and modifications may be made therein without departing from the scope of the appended claims.

What is claimed:

1. A silencer for the air intake system of an internal combustion engine adapted to be mounted within an engine chamber comprising:

an air passage tue having an air inlet for drawing ambient intake air into the engine at a pressure in the air passage tube below ambient a side branch tube having a first end connected to said air passage tube and having a second closed end for attenuating noise produced by the air drawn into said air passage tube, said side branch tube being at least partially flexible to allow said second closed end to be selectively positioned and mounted within said engine chamber without affecting the position of said first end.

2. A silencer according to claim 1, wherein said side branch tube is entirely flexible for convenient mounting thereof.

3. A silencer according to claim 2, wherein said side branch tube comprises a tube of woven cloth reinforced with a helical wire held against the inner surface thereof and a protective layer of synthetic resin covering said tube of woven cloth for increased noise attenuation.

4. A silencer according to claim 1, wherein said side branch tube includes a flexible bellows tube portion.

5. A silencer according to claim 1, wherein said side branch tube comprises a first tube member connected to said air passage tube and a second tube member connected to said first tube member and having a closed end.

6. A silencer according to claim 5, wherein one of said first and second tube members includes a flexible bellows tube portion.

7. A silencer according to claim 5, wherein each of said first and second tube members is curved only two-dimensionally.

8. A silencer according to claim 7, wherein said first and second tube members are blow molded.

9. A silencer according to claim 1, wherein said side branch tube includes a lowermost portion having a water drain hole defined therein and said drain hole having a cross-sectional area which is approximately 1% or less of the cross-sectional area of said side branch tube.

10. A silencer according to claim 9 wherein said lowermost portion is said closed second end.

11. A silencer according to claim 1, wherein a resonator chamber is connected to said air passage tube.

12. A silencer according to claim 1, wherein said air passage tube includes two tube members jointed by a curved and flexible tubular means.

13. A silencer according to claim 12 wherein said side branch tube has its first end connected to said curved and flexible tubular means.

14. A silencer for the air intake system of an internal combustion engine adapted to be mounted within an engine compartment, comprising:

an air passage tube positioned within said engine compartment having an air inlet for drawing ambient intake air into the engine at a pressure in the air passage tube below ambient pressure;

a side branch tube having a first end connected to said air passage tube and having a second closed end for attenuating noise produced in a high frequency range by the air drawn into said air passage tube; and a resonator chamber connected to said air passage tube for attenuating noise produced in a low frequency range by the air drawn into said air passage tube.

15. A silencer according to claim 14, wherein said side branch tube includes a flexible tube portion.

16. A silencer for the air intake system of an internal combustion engine adapted to be mounted within the engine compartment of an automobile, comprising:

an air passage tube having a first end connected to the engine and extending a substantial distance to an open second end at a predetermined location in the engine compartment for forming an air inlet for drawing ambient air into the engine at a pressure in the air passage tube below ambient pressure, a side branch tube having a first end connected to said air passage tube at a location substantially spaced from said open second end of said air passage tube, said side branch tube having a closed second end; and said side branch tube being of substantial length for attenuating high frequency noise and having a flexible portion for allowing the side branch tube to be selectively positioned in and mounted in the engine compartment without interfering with other engine components therein.

17. The silencer of claim 16, wherein said closed second end of said side branch tube includes a drain hole of a cross-sectional area of substantially 1% or less of the cross-sectional area of said side branch tube.

18. The silencer of claim 16, wherein a resonator chamber is connected to said air passage tube.

19. A silencer for the air intake system of an internal combustion engine adapted to be mounted within an engine compartment comprising:

an air passage tube having an air inlet for introducing engine intake air thereinto;

a side branch tube having a first end connected to said air passage tube and having a second closed end for attenuating noise produced by the air introduced into said air passage tube, said side branch tube being at least partially flexible;

said side branch tube further comprising a first tube member connected to the air passage tube and a second tube member connected to the first tube member and having a closed end; and one of said first and second tube members having a larger-diameter portion at an end thereof connected to the other tube member, said larger-diameter portion having a pair of diametrically opposite recesses, said other tube member having a pair of diametrically opposite projections fitted complementarily in said recesses.

20. A silencer for the air intake system of an internal combustion engine comprising:

an air passage tube having an air inlet for introducing engine intake air thereinto;

a side branch tube having a first end connected to said air passage tube and having a second closed end for attenuating noise produced by the air introduced into said air passage tube, said side branch tube being at least partially flexible;

a resonator chamber that is connected to said air passage tube; and a connector tube that connects said resonator chamber to said air passage tube and said connector tube is substantially shorter than said side branch tube.

21. A silencer for the air intake system of an internal combustion engine comprising:

an air passage tube having an air inlet for introducing engine intake air thereinto;

a side branch tube having a first end connected to said air passage tube and having a second closed end for attenuating noise produced by the air introduced into said air passage tube, said side branch tube being at least partially flexible;

a resonator chamber that is connected to said air passage tube; and said resonator chamber is connected to said air passage tube at a location closer to said air inlet than the connection of said side branch tube to said air passage tube.

22. A silencer for the air intake system of an internal combustion engine adapted to be mounted within an engine chamber comprising:

an air passage tube having an air inlet for drawing ambient intake air into the engine at a pressure in the air passage tube below ambient pressure, said air passage tube being mounted adjacent to said internal combustion engine;

a side branch tube having a first end connected to said air passage tube and having a second closed end for attenuating noise produced in a high frequency range by the air drawn into said air passage tube, said side branch tube being partially flexible to allow the side branch tube to be routed through various positions within said engine chamber; and a resonator chamber connected to said air passage tube for attenuating noise produced in a low frequency range by the air drawn into said air passage tube.

23. A silencer for the air intake system of an internal combustion engine adapted to be mounted to a radiator system adjacent to said internal combustion engine, comprising:

an air passage tube having an air inlet for drawing ambient air into the engine at a pressure in the air passage tube below ambient pressure;

a side branch tube having a first end connected to said air passage tube and having a second closed end for attenuating noise produced in a high frequency range by the air drawn into said air passage tube, said second end being secured to said radiator system; and a resonator chamber connected to said air passage tube for attenuating noise produced in a low frequency range by the air drawn into said air passage tube.

24. A silencer for the air intake system of an internal combustion engine for an automobile, comprising, an air passage tube having a first end connected to the engine and extending a substantial distance to an open second end at a predetermined location in the automobile for forming an air inlet, a side branch tube having a first end connected to said air passage tube at a location substantially spaced from said open second end of said air passage tube, said side branch tube having a closed second end, and said side branch tube being of substantial length for attenuating high frequency noise and having a flexible portion for allowing the side branch tube to be selectively positioned in and mounted on the automobile without interfering with other automobile components, and a resonator chamber connected to said air passage tube wherein a connector tube connects said resonator chamber to said air passage tube, and said side branch tube is substantially longer than said connector tube.

* * * * *